US007134848B2

(12) United States Patent
Olbert et al.

(10) Patent No.: US 7,134,848 B2
(45) Date of Patent: Nov. 14, 2006

(54) PUMP FOR TRANSPORTING HEAT-EXCHANGE MEDIUM FOR A MULTI-TUBE REACTOR

(75) Inventors: Gerhard Olbert, Dossenheim (DE); Torsten Mattke, Freinsheim (DE); Matthias Kummer, Weisenheim (DE); Thomas Rühl, Frankenthal (DE); Frank Rosowski, Mannheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 328 days.

(21) Appl. No.: 10/479,625

(22) PCT Filed: Jun. 5, 2002

(86) PCT No.: PCT/EP02/06172

§ 371 (c)(1),
(2), (4) Date: Dec. 4, 2003

(87) PCT Pub. No.: WO02/099287

PCT Pub. Date: Dec. 12, 2002

(65) Prior Publication Data

US 2004/0156721 A1 Aug. 12, 2004

(30) Foreign Application Priority Data

Jun. 6, 2001 (DE) ..... 101 27 365

(51) Int. Cl.
*G21C 19/04* (2006.01)

(52) U.S. Cl. ..... 417/313; 376/406

(58) Field of Classification Search ..... 417/313, 417/424.1; 376/207, 210

See application file for complete search history.

(56) References Cited

U.S. PATENT DOCUMENTS 1,383,380 A 7/1921 Boggs
3,566,961 A 3/1971 Lorenz ..... 165/159
3,762,465 A * 10/1973 Gutlhuber ..... 165/104.31

(Continued)

FOREIGN PATENT DOCUMENTS

DE 1 601 162 10/1970

(Continued)

OTHER PUBLICATIONS

*Pat. Abst. of Japan*, Pub.No. 59138794, Aug. 9, 1984 (JP 58011306, Jan. 28, 1983).

(Continued)

*Primary Examiner*—Anthony D. Stashick
*Assistant Examiner*—Samuel E. Belt
(74) *Attorney, Agent, or Firm*—Novak Druce & Quigg LLP

(57) ABSTRACT

The invention relates to a pump (1) having a pump guide tube (13) for the transport of a heat-exchange medium (6) for a reactor having a bundle of catalyst tubes (2), where the pump (1) has a casing (14) which surrounds the pump guide tube (13), having an aperture (15) in the lower part of the casing (14) via which the heat-exchange medium (6) discharged from the lower region of the reactor by means of the pump (1) flows into the casing (14), flows upward in the region between the inner wall of the casing (14) and the outer wall of the pump guide tube (13), if desired via a heat exchanger (18), flows into the interior of the pump guide tube (13) via an aperture (16) in the upper region of the pump guide tube (13), flows through the pump guide tube (13) from top to bottom and flows via an aperture (17) in the lower region of the pump guide tube (13) into the reactor, into the upper region of the interspace between the catalyst tubes (2).

15 Claims, 4 Drawing Sheets

U.S. PATENT DOCUMENTS

Figure 1:
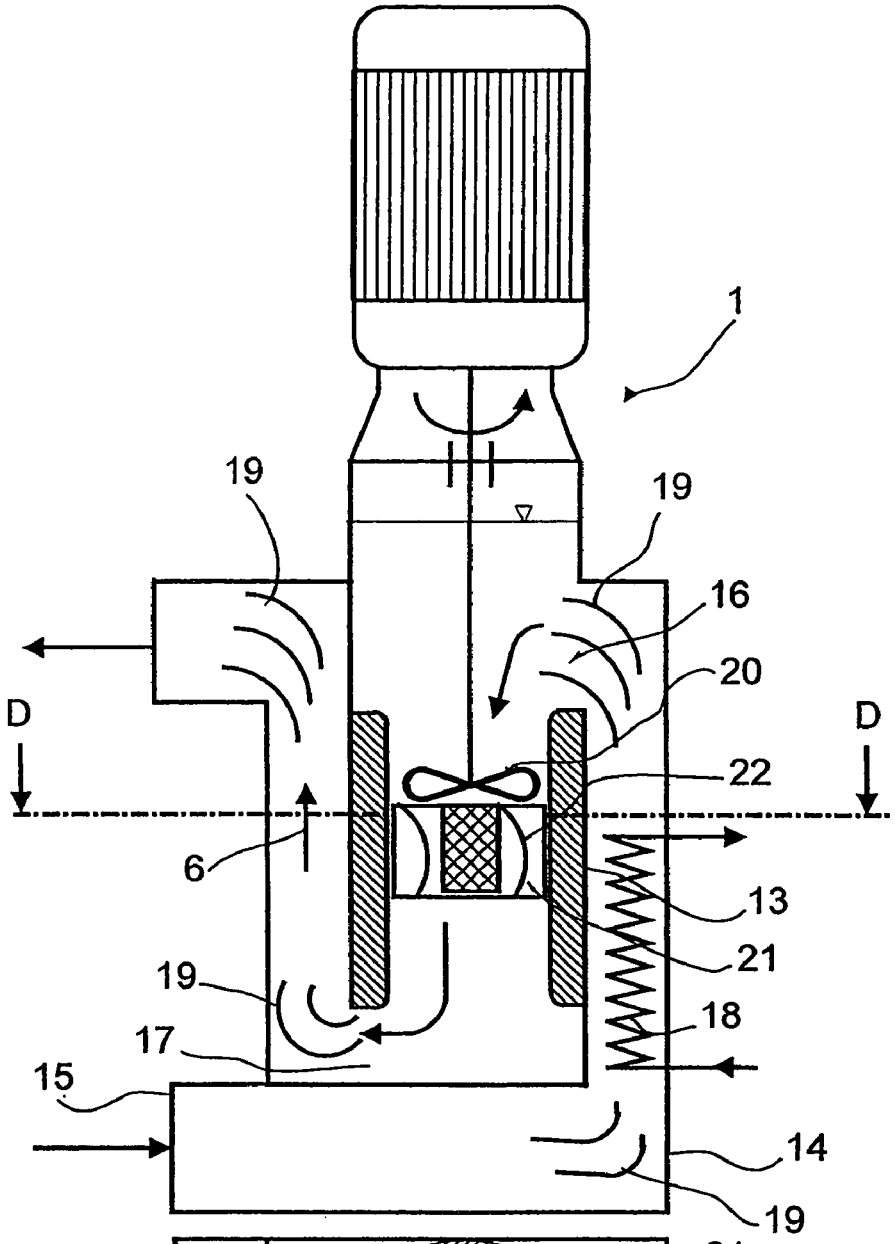

| | | | | |
|---|---|---|---|---|
| 3,871,445 | A * | 3/1975 | Wanka et al. | 165/104.14 |
| 4,657,741 | A | 4/1987 | Vogl | 422/202 |
| 5,739,391 | A | 4/1998 | Ruppel et al. | 562/532 |
| 6,756,023 | B1 | 6/2004 | Corr et al. | 422/198 |

FOREIGN PATENT DOCUMENTS

| | | |
|---|---|---|
| DE | 34 09 159 | 9/1985 |
| DE | 44 31 949 | 3/1995 |
| DE | 198 36 792 | 2/2000 |
| DE | 19836792 | 2/2000 |
| DE | 198 57 842 | 6/2000 |
| GB | 310157 | 4/1929 |

OTHER PUBLICATIONS

Derwent Abst. 2000-293755/26 (DE 19836792, Aug. 13, 1998).

* cited by examiner

D - D

E - E

PUMP FOR TRANSPORTING HEAT-EXCHANGE MEDIUM FOR A MULTI-TUBE REACTOR

The invention relates to a pump for the transport of a heat-exchange medium for a contact tube bundle reactor, and to the use of the pump.

The conventional design of contact tube bundle reactors consists of a generally cylindrical tank in which a bundle, i.e. a multiplicity, of contact tubes, is accommodated, usually in a vertical arrangement. These contact tubes, which may contain supported or unsupported catalysts, are attached with their ends in tube bases in a sealing manner and open into a hood connected to the tank at the upper end and a hood connected to the tank at the lower end. The reaction mixture flowing through the contact tubes is fed in and led out via these hoods. A heat-exchange medium circuit passes through the space surrounding the contact tubes in order to equalize the heat balance, in particular in the case of highly exo- or endothermic reactions.

Regarding the heat-exchange medium circuit, it is known to implement a substantially homogeneous temperature distribution of the heat-exchange medium in each horizontal section through the reactor in order that wherever possible all the contact tubes take part equally in the reaction events (for example DE-B-16 01 162). Smoothing of the temperature distribution is effected by heat supply or dissipation via outer ring lines installed at the reactor ends and having a multiplicity of jacket apertures, as described, for example, in DE-B-34 09 159.

A further improvement in heat transfer is achieved by installation of baffle plates which leave a passage cross section free alternately in the reactor center and at the reactor edge. Such an arrangement is particularly suitable for tube bundles in an annular arrangement with a free central space and is disclosed, for example, in GB-B-310,157. The baffle plates lead to a crossflow around the contact tubes, resulting in an increase in the flow rates and in the heat transfer.

In large reactors which have a number of contact tubes in the range from about 10,000 to 50,000 and especially from about 15,000 to 33,000 and which are additionally equipped with baffle plates, the pressure drop of the heat-exchange medium is comparatively very large.

In reactors of this type, the pump system is advantageously located between the upper and lower ring lines, with the heat-exchange medium being fed into the lower region of the reactor, for example via a ring line.

If the salt melt were to be pumped directly into the upper part of the reactor or the upper ring line, the requisite feed height of from 4 to 5 m would require a technically unfavorable and fault-susceptible pump system, inter alia due to complex pump-shaft seals, longer pump shafts, and greater heat introduction through the pump shaft into the lower motor bearing. Furthermore, the above-mentioned feed height would require a high-level salt-melt compensation vessel, which is undesired for safety reasons. All the pump pressure would bear against the shaft seal.

Supply of heat-exchange medium to the upper end of the reactor, i.e. in cocurrent with the reaction mixture, likewise fed into the contact tubes at the upper end of the reactor, is, as is known, advantageous for carrying out the reaction DE-A-44 31 949.

The cocurrent method has advantages over the countercurrent procedure, such as higher throughputs, lower catalyst hot-spot temperatures, a welcome increase in the heat-exchange medium temperature toward the end of the reaction in the contact tubes, good temperature uniformity of the heat-exchange medium over the reactor cross section, i.e. good horizontal temperature layering, clear operating states over the height of the contact tube space owing to the lack of back-coupling through the heat-exchange medium.

However, cocurrent transport of the reaction mixture and heat-exchange medium, as described in DE-A-44 31 949, comes up against the above-mentioned problems regarding the pump system if the heat-exchange medium is fed to the upper region of the reactor, for example directly via an upper ring line, and discharged from the lower region of the reactor, for example directly via a ring line.

DE 198 367 92 discloses that the space between the upper and lower ring lines for the supply of heat-exchange medium in a contact tube bundle reactor can be used for deflection of the heat-exchange medium, it being possible to combine the advantage of cocurrent transport of heat-exchange medium and reaction mixture in the proven pump arrangement with supply of the heat-exchange medium to the lower ring line. To this end, it has been proposed to arrange a cylindrical partition wall in the upper and lower ring lines which divides each of the latter into an inner ring line and an outer ring line. The heat-exchange medium is fed to the outer, lower ring line, which is connected, via a region between the upper and lower ring lines, to the inner, upper ring line, and from there it is fed, in a known manner, via jacket apertures into the space surrounding the contact tubes, with a meander-like flow being formed via deflection disks. The heat-exchange medium leaves the space surrounding the contact tubes in the lower part of the reactor via jacket apertures and enters the lower, inner ring line. This is in turn connected to the upper, outer ring line via the region between the upper and lower ring lines.

It is an object of the present invention to find a further solution, in particular one that is simpler from the manufacturing point of view, to the problem that, although the heat-exchange medium is employed with the conventional pump arrangement, i.e. with transport from the bottom, the heat-exchange medium should nevertheless enter the interspace between the contact tubes of a vertically arranged contact tube bundle reactor in the upper region thereof. The aim is for this problem to be solved in a simple manner, in particular without changes to the contact tube bundle reactor itself.

We have found that this object is achieved by a pump having a pump guide tube for the transport of a heat-exchange medium for a reactor having a bundle of contact tubes with a vertically arranged longitudinal axis, with supply of the heat-exchange medium in the upper region of the reactor and discharge of the heat-exchange medium from the lower region of the reactor, preferably in each case via a ring line, wherein the pump has a casing which surrounds the pump guide tube, having an aperture in the lower part of the casing via which the heat-exchange medium discharged from the lower region of the reactor by means of the pump flows into the casing, flows upward in the region between the inner wall of the casing and the outer wall of the pump guide tube, if desired via a heat exchanger, flows into the interior of the pump guide tube via an aperture in the lower region of the pump guide tube, flows through the pump guide tube from top to bottom and flows via an aperture in the lower region of the pump guide tube into the reactor, into the upper region of the interspace between the contact tubes.

The invention is not limited with regard to the design of the supply or discharge of the heat-exchange medium from the reactor. Heat-exchange medium supply and discharge may each preferably take place via a ring line. But other flow systems are possible as well, for example via spaces which are opposite each other in the reactor space and which are contact tube free, as described in DE-A 198 57 842 in conjunction with reactor modules having a rectangular cross section.

In a preferred embodiment, the heat-exchange medium flows via the aperture in the lower region of the pump guide tube into a further interspace between the inner wall of the casing and the outer wall of the pump guide tube, flows through this interspace from bottom to top and flows via an aperture in the upper region of the interspace into the reactor, into the upper region of the interspace between the contact tubes.

In a further preferred embodiment, the pump is placed higher such that it transports the heat-exchange medium directly, especially via an upper ring line, into a reactor having a bundle of catalyst tubes, into the interspace between the contact tubes.

In this embodiment, it is advantageous for one or more vent lines to be provided from the upper region of the reactor into the pump. If a plurality of vent lines are provided, they are in particular symmetrically disposed around the reactor circumference and are gathered together in a collect line before supply to the pump. The vent line or lines may be structured for example as stubs on the reactor shell, at a small distance below the upper tube plate or as drill-holes in the reactor plate itself which lead from the reactor interior to outside the reactor. The vent line or lines are preferably led upwardly along the outside wall of the pump housing, especially in the immediate vicinity thereof. This embodiment is advantageous from a heat-engineering viewpoint, since it does not require an additional external heating for the heat-exchange medium.

The vent line or lines can if desired be constructed such that they terminate in the pump below or above the liquid level.

The invention thus provides a pump having a casing which causes deflection of the heat-exchange medium stream transported by the pump.

The pump according to the invention is preferably a propeller pump, in particular having a propeller with three or more blades.

For the transport of liquid heat-exchange media, frequently of salt melts, for the supply or dissipation of the heat of reaction from contact tube bundle reactors, use is made of axial feed pumps, frequently propeller pumps. The propeller pump transports the desired liquid, in the present case a heat-exchange medium, for example a salt melt or a heat-transfer oil, by means of the propeller, which rotates in the pump guide tube. The propeller is preferably separated from the pump guide tube by a distance in the range from 2 to 10 mm. Transport of the liquid from top to bottom in the pump guide tube is necessary here since otherwise sealing problems, in particular, occur. The pump guide tube is generally a hollow cylinder surrounding the propeller.

In the present case, a casing is provided around the pump guide tube which encloses the pump guide tube and which, in combination with apertures provided at suitable points in the pump guide tube, is designed in such a way that it effects deflection of the heat-exchange medium stream in the pump.

To this end, the casing has in its lower region an aperture into which the heat-exchange medium discharged from the reactor flows, is directed upward in a region between the pump guide tube and the inner wall of the casing, flows into the interior of the pump guide tube via an aperture in the upper region of the pump guide tube, flows through the pump guide tube, as usual, from top to bottom, leaves it via an aperture in its lower region, flows into a further interspace between the inner wall of the casing and the outer wall of the pump guide tube, flows through this interspace from bottom to top, and finally leaves this interspace into an aperture in its upper region and is fed back to the reactor in its upper region.

The apertures in the pump guide tube and in the casing do not extend over the entire cross-sectional area of the pump guide tube or of the casing, but instead merely over from about 20 to 50%, preferably over about 30%, thereof. The reduced region, i.e. the aperture, can be stabilized by suitable braces. It is also possible to implement the apertures in the pump guide tube or in the casing in such a way that the pump guide tube or the casing is formed in the corresponding regions by a perforated sheet or has slots.

The casing can have a design which is simple to manufacture with a rectangular cross section, but it is also possible, in particular for higher pressure loads, for the casing to be designed with a circular cross section.

Baffle plates for the heat-exchange medium are preferably arranged in one or more deflection regions of the casing.

In a preferred embodiment, a diffuser fitted with blades is arranged beneath the propeller in order to eliminate the twist from the stream. The diffuser is preferably designed in such a way that its flow cross section corresponds to the flow cross section in the region of the propeller.

In a preferred embodiment, a pivot which rotates in a bearing is provided at the lower end of the pump shaft. This enables the propeller to be operated at a higher peripheral speed, and the width of the gap between the propeller and the inner wall of the pump guide tube can be reduced, the pump runs more precisely and requires less maintenance since the load on the upper bearing is reduced. The pump can thus manage a greater volume flow and a greater transport height. If the pump transports a salt melt as heat-exchange medium, the heat-exchange itself provides lubrication for the bearing. The bearing may additionally be reinforced with tungsten-carbide steel.

In a preferred embodiment, the pump is arranged higher in such a way that it transports the heat-exchange medium directly into the upper ring line of a reactor having a bundle of contact tubes. In this embodiment, a vent line is provided from the upper region of the reactor into the pump, above the liquid level therein. A heat expansion compensator is advantageously installed in the line connecting the lower ring line to the pump.

The pump according to the invention is particularly suitable for the transport of the heat-exchange medium stream for contact tube bundle reactors for carrying out exothermic or endothermic reactions, in particular oxidation reactions.

Figure 1A:
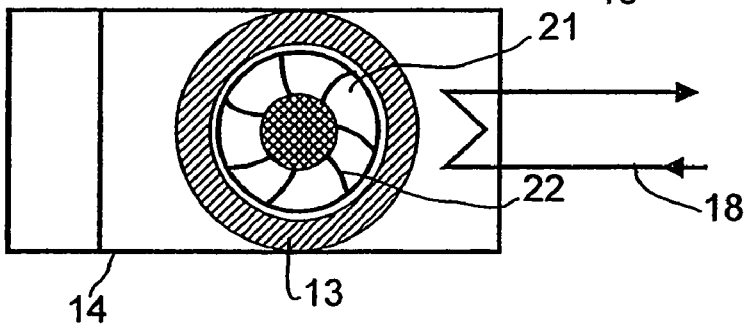
Figure 2:
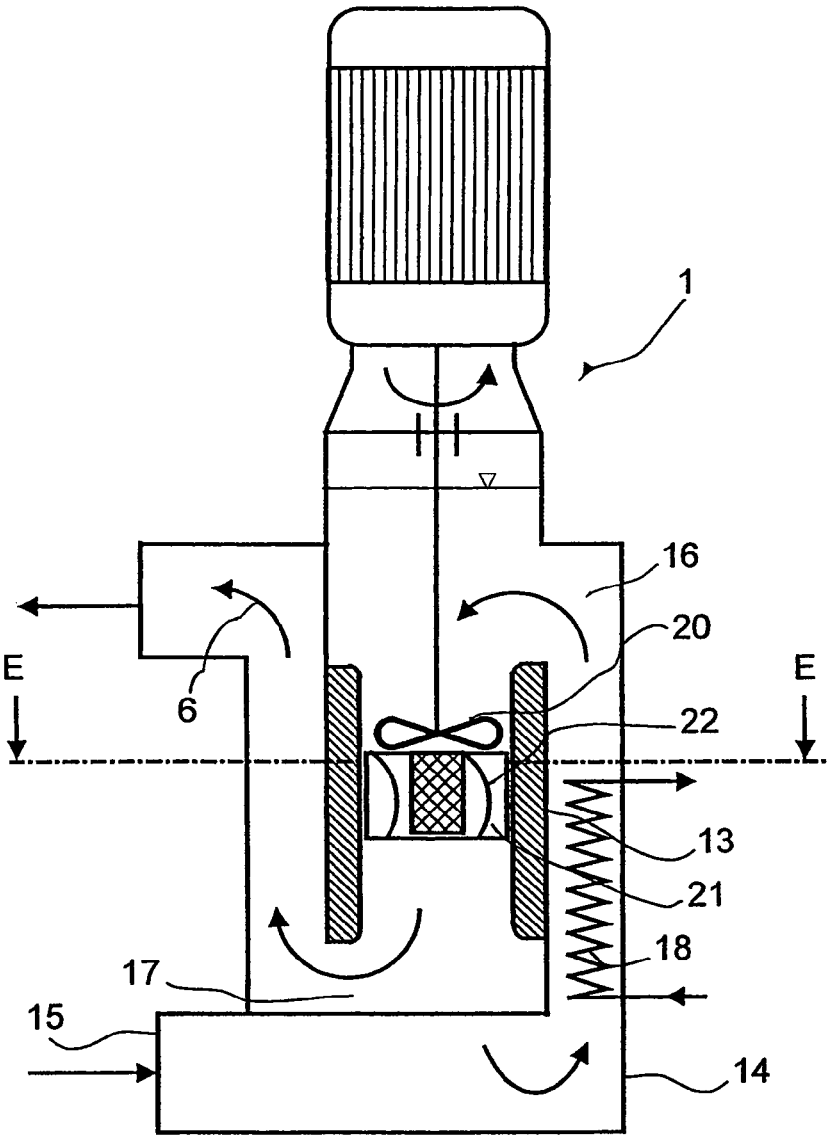
Figure 2A:
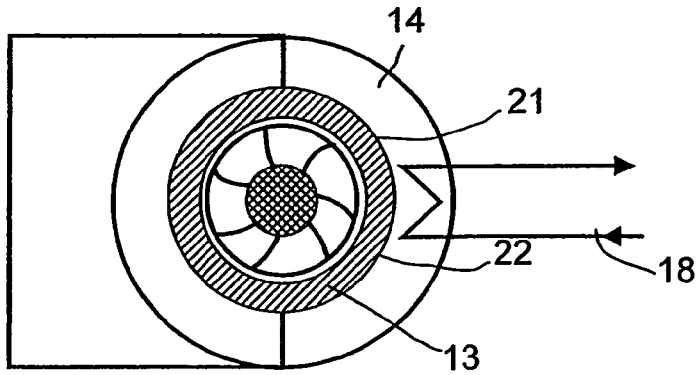
Figure 3:
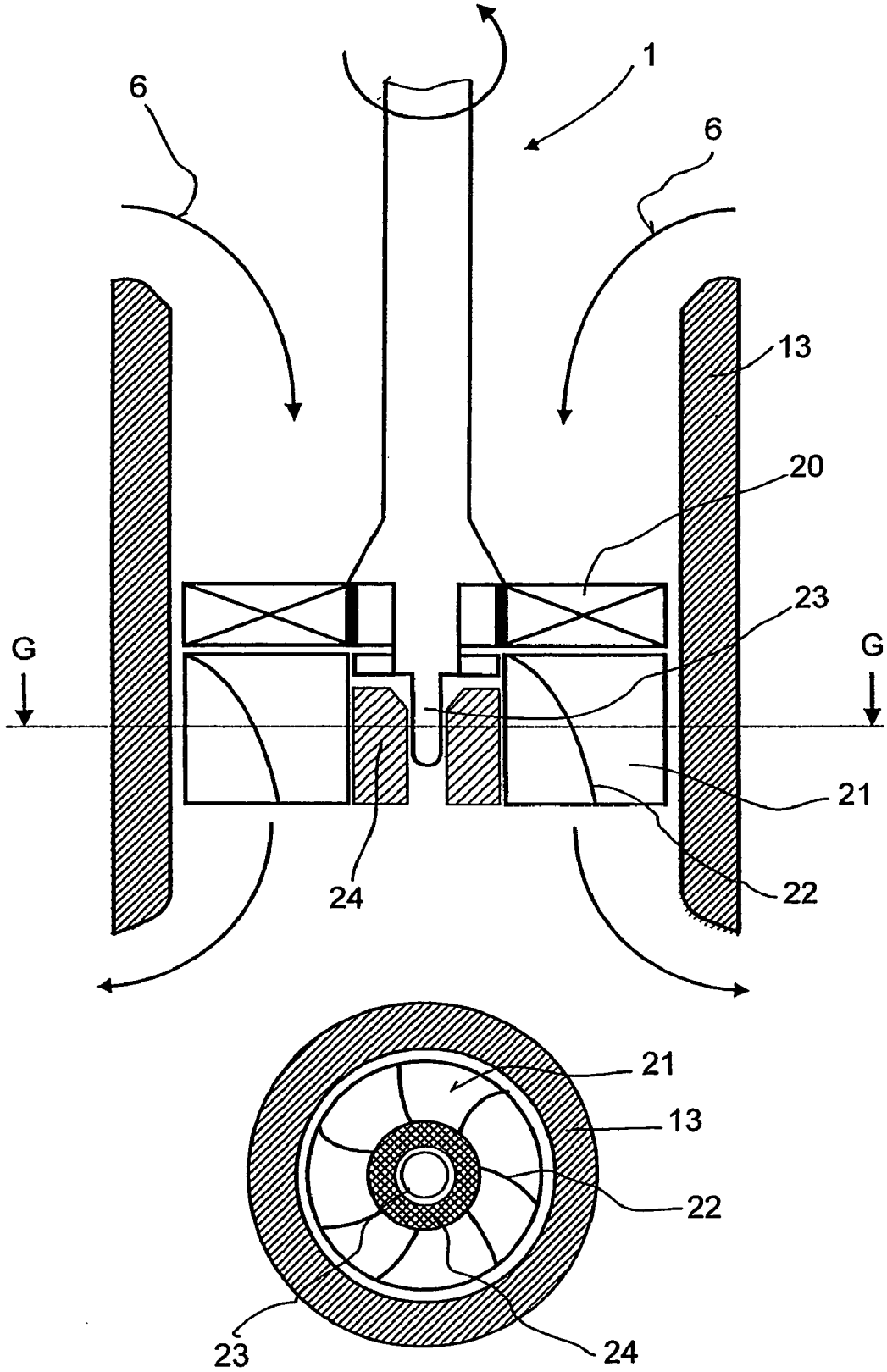
Figure 4:
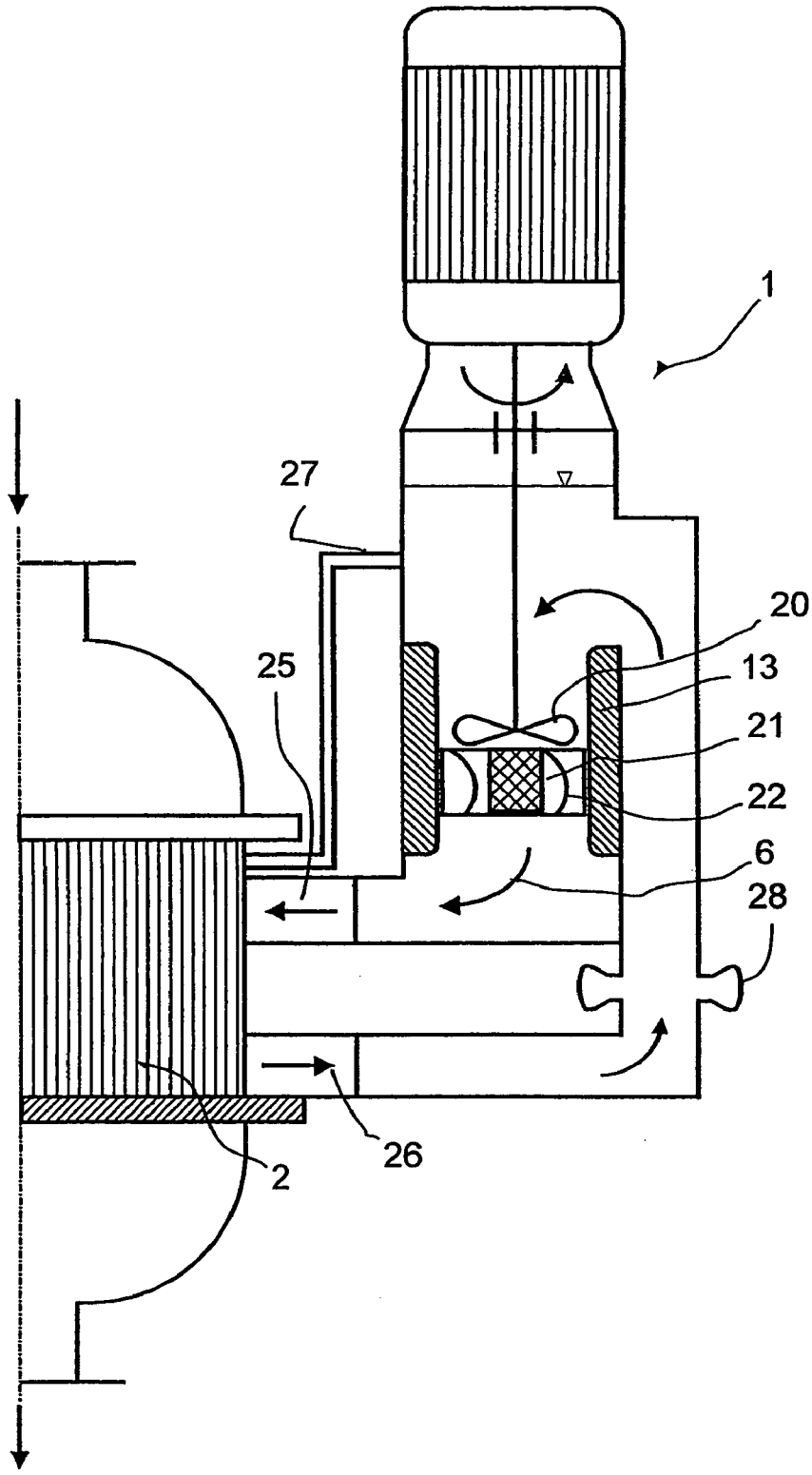

The invention is explained in greater detail below with reference to a drawing, in which, in detail:

FIG. 1 shows a preferred pump variant for the deflection of the heat-exchange medium stream in the pump, with cross-sectional view in FIG. 1*a*, FIG. 2 shows a further preferred embodiment for the deflection of the heat-exchange medium stream in the pump, with cross-sectional view in FIG. 2*a*, FIG. 3 shows a further embodiment with a pivot at the lower end of the pump shaft, and FIG. 4 shows a further preferred alternative with arrangement of the pump above the reactor and direct transport of the heat-exchange medium stream into the upper ring line of the reactor.

FIG. 1 shows a pump 1 with deflection of the heat-exchange medium 6 in the pump with guide tube 13 with inflow 16 in the upper region and outflow 17 in the lower region thereof, with casing 14 around the guide tube 13, and a heat exchanger 18 arranged in the casing 14. The heat exchanger is merely shown by way of example, it likewise being possible to design the pump without heat exchanger. The cross section D—D in FIG. 1*a* illustrates the rectangular cross-sectional design of the casing 14. A diffuser 21 with blades 22 is arranged beneath the propeller 20.

Preferably, baffle plates 19 for the heat-exchange medium 6 are arranged in one or more deflection regions of the casing 14.

FIG. 2 shows a further embodiment of a pump 1 for the deflection of the heat-exchange medium 6 with cross section E—E in FIG. 2*a*, where, in contrast to the depiction in FIG. 1, the casing 14, as illustrated in the cross-sectional view in FIG. 2*a*, is arranged in circular cross-section around the pump guide tube 13.

FIG. 3 shows a preferred pump variant with a guide pivot 23 at the lower end of the pump shaft which rotates in a bearing 24.

FIG. 4 illustrates a particularly advantageous arrangement of a pump 1 with propeller 20 and with diffuser 21 with blades 22 which transports the heat-exchange medium 6 directly into the upper ring line 25 of a reactor having a bundle of contact tubes 2. Reference numeral 26 denotes the lower ring line, via which the heat-exchange medium is withdrawn by the pump 1. A heat expansion compensator 28 may, in accordance with the depicted preferred embodiment, be installed in the feed line from the lower ring line 26 to the pump 1, and a vent line 27 leads from the upper region of the reactor into the pump, above the liquid level therein. In this arrangement, too, baffle plates for the heat-exchange medium may preferably be arranged in the deflection regions of the casing 14.

We claim:

1. A pump having a pump guide tube for the transport of a heat-exchange medium for a reactor having a bundle of catalyst tubes with a vertically arranged longitudinal axis, with supply of the heat-exchange medium in the upper region of the reactor into the interspace between the contact tubes and discharge of the heat-exchange medium from the lower region of the reactor, wherein the pump has a casing which surrounds the pump guide tube, having an aperture in the lower part of the casing via which the heat-exchange medium discharged from the lower region of the reactor by means of the pump flows into the casing, flows upward in the region between the inner wall of the casing and the outer wall of the pump guide tube, flows into the interior of the pump guide tube via an aperture in the upper region of the pump guide tube, flows through the pump guide tube from top to bottom and flows via an aperture in the lower region of the pump guide tube into the reactor, into the upper region of the interspace between the catalyst tubes, wherein the heat-exchange medium flows via the aperture in the lower region of the pump guide tube into a further interspace between the inner wall of the casing and the outer wall of the pump guide tube, flows through this interspace from bottom to top and flows via an aperture in the upper region of the interspace into the reactor, into the upper region of the interspace between the contact tubes.

2. A pump as claimed in claim 1, wherein the pump transports the heat-exchange medium directly into the upper region of a reactor having a bundle of catalyst tubes.

3. A pump as claimed in claim 1, wherein the pump is an axial pump.

4. A pump as claimed in claim 1, wherein the casing (14) is designed with a rectangular cross section.

5. A pump as claimed in claim 1, wherein the casing is designed with a circular cross section.

6. A pump as claimed in claim 1, wherein baffle plates for the heat-exchange medium are arranged in one or more deflection regions of the casing.

7. A pump as claimed in claim 1, wherein a diffuser with blades is arranged in the pump guide tube beneath the propeller.

8. A pump as claimed in claim 1, wherein a guide pivot which rotates in a bearing is arranged at the lower end of the pump shaft.

9. A process for carrying out exothermic or endothermic reactions, said process comprising transporting a heat-exchange medium with the pump of claim 1 through a reactor having a bundle of catalyst tubes.

10. A pump as claimed in claim 1, wherein the aperture in the lower region of the pump guide is located higher than the aperture in the lower part of the casing.

11. A pump as claimed in claim 1, wherein the aperture in the upper region of the interspace between the inner wall of the casing and the outer wall of the pump guide tube is located higher than the aperture in the lower part of the casing.

12. A pump as claimed in claim 1, wherein the discharge of the heat-exchange medium from the lower region of the reactor flows into the casing in each case via a ring line.

13. A pump as claimed in claim 1, wherein the heat-exchange medium flows upward in the region between the inner wall of the casing and the outer wall of the pump guide tube via a heat exchanger.

14. A pump as claimed in claim 2, wherein the pump transports the heat-exchange medium directly into the upper ring line of a reactor having a bundle of catalysts.

15. A pump as claimed in claim 3, wherein the pump is a propeller pump having a propeller having three or more blades.

* * * * *